US012693076B2

(12) United States Patent
Li et al.

(10) Patent No.: US 12,693,076 B2
(45) Date of Patent: Jul. 28, 2026

(54) HEAT EXCHANGER AND AIR CONDITIONING SYSTEM HAVING THE SAME

(71) Applicant: Danfoss A/S, Nordborg (DK)

(72) Inventors: Yanxing Li, Nordborg (DK); Leilei Wang, Haiyan (CN); Jing Yang, Nordborg (DK)

(73) Assignee: DANFOSS A/S, Nordborg (DK)

( * ) Notice: Subject to any disclaimer, the term of this patent is extended or adjusted under 35 U.S.C. 154(b) by 205 days.

(21) Appl. No.: 18/057,812

(22) Filed: Nov. 22, 2022

(65) Prior Publication Data

US 2023/0168038 A1 Jun. 1, 2023

(30) Foreign Application Priority Data

Nov. 29, 2021 (CN) ..... 202122964995.1

(51) Int. Cl.

| | |
|---|---|
| ***F28D 1/053*** | (2006.01) |
| ***F28F 1/10*** | (2006.01) |
| ***F28F 9/00*** | (2006.01) |

(52) U.S. Cl.

CPC ..... *F28D 1/05366* (2013.01); *F28F 1/10* (2013.01); *F28F 9/001* (2013.01); *F28F 2009/004* (2013.01)

(58) Field of Classification Search

CPC ..... F25B 2400/06; F28D 2001/0266; F28D 2001/0273; F28D 1/047; F28D 1/0471;

(Continued)

(56) References Cited

U.S. PATENT DOCUMENTS

2003/0178188 A1* 9/2003 Coleman ..... F28F 1/022 165/110
2013/0240186 A1* 9/2013 Taras ..... F28D 1/05358 165/146

(Continued)

FOREIGN PATENT DOCUMENTS

| | | | |
|---|---|---|---|
| CN | 107218822 | A | 9/2017 |
| CN | 111322794 | A | 6/2020 |
| CN | 111322795 | A | 6/2020 |

*Primary Examiner* — Steve S Tanenbaum

(74) *Attorney, Agent, or Firm* — McCormick, Paulding & Huber PLLC

(57) ABSTRACT

The present disclosure discloses a heat exchanger and an air conditioning system having the heat exchanger. The heat exchanger includes a first heat exchanger core, a second heat exchanger core and a connection part. Heat exchange tubes of the first heat exchanger core and the second heat exchanger core include first circuit heat exchange tubes. A length of the heat exchange tube of the first heat exchanger core is greater than a length of the heat exchange tube of the second heat exchanger core. The connection part includes a first connection part through which the first circuit heat exchange tubes of the first heat exchanger core are connected with the first circuit heat exchange tubes of the second heat exchanger core. The heat exchange tubes of at least one of the first heat exchanger core and the second heat exchanger core further include second circuit heat exchange tubes. First circuit heat exchange tube groups each constituted by at least one of the first circuit heat exchange tubes and second circuit heat exchange tube groups each constituted by at least one of the second circuit heat exchange tubes are arranged alternately. Thereby, the heat exchange performance can be improved at both partial load and full load.

18 Claims, 12 Drawing Sheets

(58) Field of Classification Search
CPC .... F28D 1/0475; F28D 1/0476; F28D 7/0008; F28D 7/0016; F28D 7/0025; F28D 7/0033
USPC ..... 165/148
See application file for complete search history.

(56) References Cited

U.S. PATENT DOCUMENTS

| | | | | |
|---|---|---|---|---|
| 2014/0026601 | A1* | 1/2014 | Chen | F25B 47/025 62/81 |
| 2014/0366571 | A1* | 12/2014 | Gao | F25B 1/005 165/173 |
| 2018/0058763 | A1* | 3/2018 | Wei | F28D 7/1638 |
| 2019/0162476 | A1* | 5/2019 | Wallet-Laily | F28B 1/06 |
| 2020/0191501 | A1* | 6/2020 | Pelletier | F28F 1/14 |
| 2020/0326140 | A1* | 10/2020 | Fuller | F28F 1/12 |
| 2021/0215431 | A1* | 7/2021 | Joardar | F24F 1/14 |

* cited by examiner

HEAT EXCHANGER AND AIR CONDITIONING SYSTEM HAVING THE SAME

CROSS-REFERENCE TO RELATED APPLICATION

This application claims foreign priority benefits under U.S.C. § 119 from Chinese Patent Application No. 202122964995.1, filed Nov. 29, 2021, the content of which is hereby incorporated by reference in its entirety.

TECHNICAL FIELD

Embodiments of the present disclosure relate to a heat exchanger and an air conditioning system having the same.

BACKGROUND

A heat exchanger includes manifolds and heat exchange tubes. The heat exchanger may include a plurality of heat exchanger cores.

SUMMARY

It is an object of embodiments of the present disclosure to provide a heat exchanger and an air conditioning system having the same, thereby, for example, improving the performance of the heat exchanger.

Embodiments of the present disclosure provide a heat exchanger including: a first heat exchanger core including a plurality of heat exchange tubes, the plurality of heat exchange tubes of the first heat exchanger core including a plurality of first circuit heat exchange tubes for forming a first circuit; a second heat exchanger core located on a side of the first heat exchanger core in a thickness direction of the first heat exchanger core and including a plurality of heat exchange tubes, the plurality of heat exchange tubes of the second heat exchanger core including a plurality of first circuit heat exchange tubes for forming the first circuit, a length of the heat exchange tube of the first heat exchanger core being greater than a length of the heat exchange tube of the second heat exchanger core; and a connection part including a first connection part through which the plurality of first circuit heat exchange tubes of the first heat exchanger core are connected with the plurality of first circuit heat exchange tubes of the second heat exchanger core; wherein the plurality of heat exchange tubes of at least one of the first heat exchanger core and the second heat exchanger core further include a plurality of second circuit heat exchange tubes for forming a second circuit, and in the at least one of the first heat exchanger core and the second heat exchanger core, first circuit heat exchange tube groups each constituted by at least one of the plurality of first circuit heat exchange tubes and second circuit heat exchange tube groups each constituted by at least one of the plurality of second circuit heat exchange tubes are arranged alternately.

According to embodiments of the present disclosure, the first heat exchanger core further includes a plurality of fins arranged alternately with the plurality of heat exchange tubes of the first heat exchanger core; and the second heat exchanger core further includes a plurality of fins arranged alternately with the plurality of heat exchange tubes of the second heat exchanger core.

According to embodiments of the present disclosure, the heat exchanger further includes: a pair of first circuit manifolds, of which one is connected with the plurality of first circuit heat exchange tubes of the first heat exchanger core at a side of the first heat exchanger core away from the connection part, and of which the other is connected with the plurality of first circuit heat exchange tubes of the second heat exchanger core at a side of the second heat exchanger core away from the connection part.

According to embodiments of the present disclosure, the first connection part includes a plurality of first connection tubes, and the plurality of first circuit heat exchange tubes of the first heat exchanger core are connected with the plurality of first circuit heat exchange tubes of the second heat exchanger core through the plurality of first connection tubes, respectively.

According to embodiments of the present disclosure, the heat exchange tube of the first heat exchanger core has a length of L1, the heat exchange tube of the second heat exchanger core has a length of L2, and $\frac{1}{5}<L2/L1<\frac{9}{10}$.

According to embodiments of the present disclosure, the plurality of heat exchange tubes of each of the first heat exchanger core and the second heat exchanger core include the plurality of second circuit heat exchange tubes for forming the second circuit.

According to embodiments of the present disclosure, the heat exchanger further includes: a pair of second circuit manifolds, of which one is connected with the plurality of second circuit heat exchange tubes of the first heat exchanger core at a side of the first heat exchanger core away from the connection part, and of which the other is connected with the plurality of second circuit heat exchange tubes of the second heat exchanger core at a side of the second heat exchanger core away from the connection part.

According to embodiments of the present disclosure, the connection part further includes a second connection part, and the plurality of second circuit heat exchange tubes of the first heat exchanger core are connected with the plurality of second circuit heat exchange tubes of the second heat exchanger core through the second connection part.

According to embodiments of the present disclosure, the second connection part includes a plurality of second connection tubes, and the plurality of second circuit heat exchange tubes of the first heat exchanger core are connected with the plurality of second circuit heat exchange tubes of the second heat exchanger core through the plurality of second connection tubes, respectively.

According to embodiments of the present disclosure, the heat exchanger further includes: another pair of second circuit manifolds, of which one is connected with the plurality of second circuit heat exchange tubes of the first heat exchanger core at a side of the first heat exchanger core near the connection part, and of which the other is connected with the plurality of second circuit heat exchange tubes of the second heat exchanger core at a side of the second heat exchanger core near the connection part.

According to embodiments of the present disclosure, the plurality of heat exchange tubes of only the second heat exchanger core further include the plurality of second circuit heat exchange tubes for forming the second circuit.

According to embodiments of the present disclosure, the heat exchanger further includes: a pair of second circuit manifolds, of which one is connected with the plurality of second circuit heat exchange tubes of the second heat exchanger core at a side of the second heat exchanger core near the connection part, and of which the other is connected with the plurality of second circuit heat exchange tubes of the second heat exchanger core at a side of the second heat exchanger core away from the connection part.

According to embodiments of the present disclosure, the plurality of heat exchange tubes of only the first heat exchanger core further include the plurality of second circuit heat exchange tubes for forming the second circuit.

According to embodiments of the present disclosure, the heat exchanger further includes: a pair of second circuit manifolds, of which one is connected with the plurality of second circuit heat exchange tubes of the first heat exchanger core at a side of the first heat exchanger core away from the connection part, and of which the other is connected with the plurality of second circuit heat exchange tubes of the first heat exchanger core at a side of the first heat exchanger core near the connection part.

According to embodiments of the present disclosure, the heat exchanger further includes: a pair of first circuit manifolds, of which one is connected with the plurality of first circuit heat exchange tubes of the first heat exchanger core at the side of the first heat exchanger core away from the connection part, and of which the other is connected with the plurality of first circuit heat exchange tubes of the second heat exchanger core at the side of the second heat exchanger core away from the connection part, wherein one of the pair of first circuit manifolds is located at a refrigerant outlet side of the heat exchanger, and one of the pair of second circuit manifolds is located at the refrigerant outlet side of the heat exchanger; and an outlet side manifold, which is in fluid communication with at least one of the first circuit manifold at the refrigerant outlet side of the heat exchanger and the second circuit manifold at the refrigerant outlet side of the heat exchanger through a connection tube.

According to embodiments of the present disclosure, the side of the first heat exchanger core away from the connection part is the refrigerant outlet side of the heat exchanger.

According to embodiments of the present disclosure, the heat exchanger further includes: a pair of first circuit manifolds, of which one is connected with the plurality of first circuit heat exchange tubes of the first heat exchanger core at the side of the first heat exchanger core away from the connection part, and of which the other is connected with the plurality of first circuit heat exchange tubes of the second heat exchanger core at the side of the second heat exchanger core away from the connection part, wherein the one of the pair of first circuit manifolds is provided at a side of the one of the pair of second circuit manifolds away from the second heat exchanger core, or the one of the pair of first circuit manifolds is provided at a side of the one of the pair of second circuit manifolds towards the second heat exchanger core.

According to embodiments of the present disclosure, the heat exchanger further includes: a pair of first circuit manifolds, of which one is connected with the plurality of first circuit heat exchange tubes of the first heat exchanger core at the side of the first heat exchanger core away from the connection part, and of which the other is connected with the plurality of first circuit heat exchange tubes of the second heat exchanger core at the side of the second heat exchanger core away from the connection part; wherein a cross-sectional area of the first circuit manifold is different from that of the second circuit manifold, or an outer diameter of the first circuit manifold is different from that of the second circuit manifold.

According to embodiments of the present disclosure, the first heat exchanger core further includes a plurality of fins arranged alternately with the plurality of heat exchange tubes of the first heat exchanger core; the second heat exchanger core further includes a plurality of fins arranged alternately with the plurality of heat exchange tubes of the second heat exchanger core; the first heat exchanger core includes a first portion and a second portion, an orthographic projection of the first portion on a plane where the first heat exchanger core is located is at least partially overlapped with an orthographic projection of the second heat exchanger core on the plane where the first heat exchanger core is located, and an orthographic projection of the second portion on the plane where the first heat exchanger core is located is located outside the orthographic projection of the second heat exchanger core on the plane where the first heat exchanger core is located; and at a same inlet wind speed, a wind resistance or pressure drop caused by at least a portion of at least one of the fins in the second portion is greater than a wind resistance or pressure drop caused by at least a portion of at least one of the fins in at least one of the second heat exchanger core and the first portion.

According to embodiments of the present disclosure, in the aspect of at least one of a fin density, a fin width, an angle of a fin louver, a quantity of the fin louvers, and a length of the fin louver, at least the portion of the at least one of the fins in the second portion is greater than at least the portion of the at least one of the fins in the at least one of the second heat exchanger core and the first portion.

According to embodiments of the present disclosure, a cross-sectional area of a flow channel of the first circuit heat exchange tube is different from that of a flow channel of the second circuit heat exchange tube; or the first circuit heat exchange tube is a flat tube, the second circuit heat exchange tube is a flat tube, and a width of the first circuit heat exchange tube is different from that of the second circuit heat exchange tube; or the first circuit heat exchange tube is a flat tube, the second circuit heat exchange tube is a flat tube, and a thickness of the first circuit heat exchange tube is different from that of the second circuit heat exchange tube.

According to embodiments of the present disclosure, the first heat exchanger core and the second heat exchanger core are configured to flow a refrigerant from the second heat exchanger core to the first heat exchanger core.

Embodiments of the present disclosure provide an air conditioning system including the above-mentioned heater exchanger.

With the heat exchanger and the air conditioning system having the same according to the embodiments of the present disclosure, for example, the performance of the heat exchanger can be improved.

DETAILED DESCRIPTION

Figure 1:
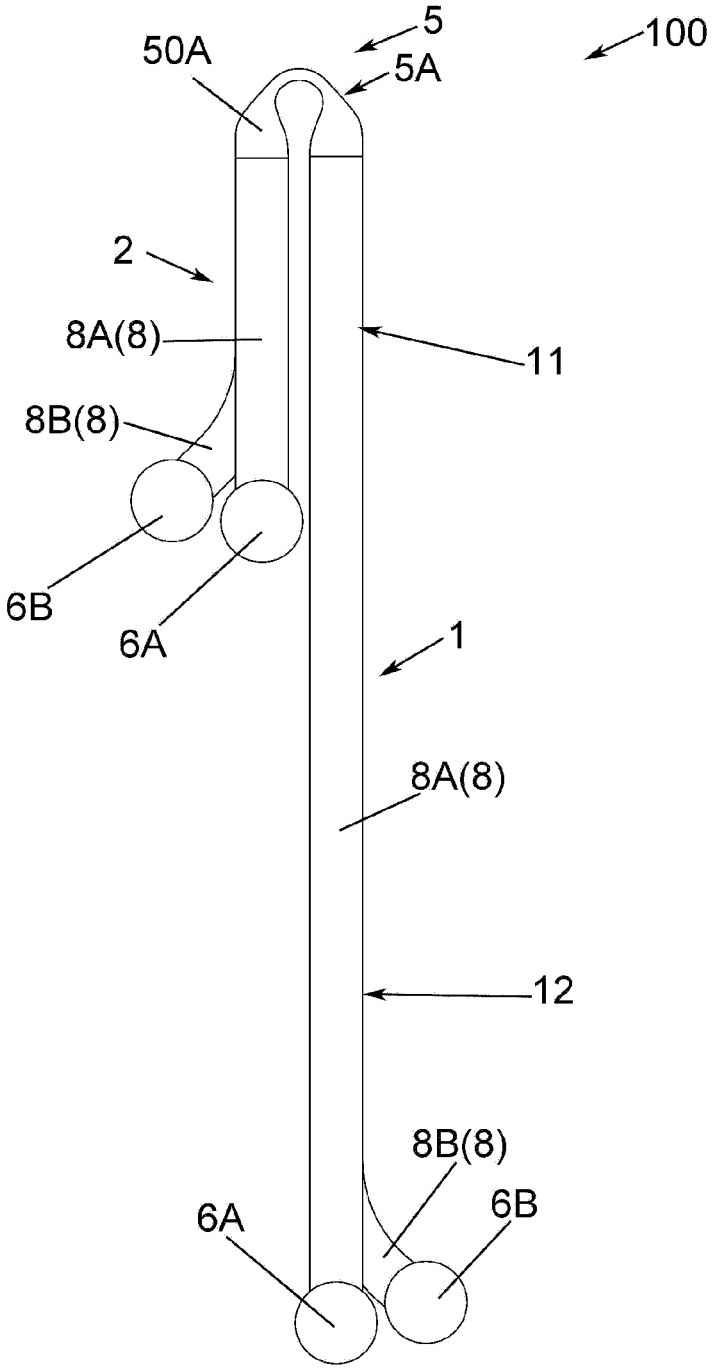
FIG. 1 is a schematic side view of a heat exchanger according to an embodiment of the present disclosure.

The present disclosure is further explained below by means of specific embodiments in conjunction with the drawings.

An air conditioning system according to embodiments of the present disclosure includes a heat exchanger. Specifically, the air conditioning system according to an embodiment of the present disclosure includes a compressor, a heat exchanger acting as an evaporator, a heat exchanger acting as a condenser, an expansion valve, and so on. The air conditioning system may include two or more cycles. In each cycle, one or more circuits of the heat exchanger are used, and the circuits of the heat exchanger are connected in parallel and are independent from each other.

Referring to FIG. 1 to FIG. 10, a heat exchanger 100 according to an embodiment of the present disclosure includes: a first heat exchanger core 1, a second heat exchanger core 2 and a connection part 5. The first heat exchanger core 1 includes a plurality of heat exchange tubes 8 and the plurality of heat exchange tubes 8 of the first heat exchanger core 1 include a plurality of first circuit heat exchange tubes 8A for forming a first circuit. The second heat exchanger core 2 is located on a side of the first heat exchanger core 1 in a thickness direction (namely the left-right direction in FIG. 1 and FIG. 3 to FIG. 10) of the first heat exchanger core 1 and includes a plurality of heat exchange tubes 8. The plurality of heat exchange tubes 8 of the second heat exchanger core 2 include a plurality of first circuit heat exchange tubes 8A for forming the first circuit. A length of the heat exchange tube 8 of the first heat exchanger core 1 is greater than a length of the heat exchange tube 8 of the second heat exchanger core 2. The connection part 5 includes a first connection part 5A through which the plurality of first circuit heat exchange tubes 8A of the first heat exchanger core 1 are connected with the plurality of first circuit heat exchange tubes 8A of the second heat exchanger core 2. The plurality of heat exchange tubes 8 of at least one of the first heat exchanger core 1 and the second heat exchanger core 2 further include a plurality of second circuit heat exchange tubes 8B for forming a second circuit; and in the at least one of the first heat exchanger core 1 and the second heat exchanger core 2, first circuit heat exchange tube groups each constituted by at least one of the first circuit heat exchange tubes 8A and second circuit heat exchange tube groups each constituted by at least one of the second circuit heat exchange tubes 8B are arranged alternately. Thus, for example, if one circuit of the air conditioning system with two circuits is closed, at least a portion of the fins for this circuit can be used for the other circuit, thereby improving the heat exchange efficiency of the heat exchanger. In addition, the heat exchange performance can be improved at both partial load and full load.

Referring to FIG. 1 to FIG. 10, in the embodiments of the present disclosure, the first heat exchanger core 1 and the second heat exchanger core 2 are configured to flow a refrigerant from the second heat exchanger core 2 to the first heat exchanger core 1.

Figure 2:
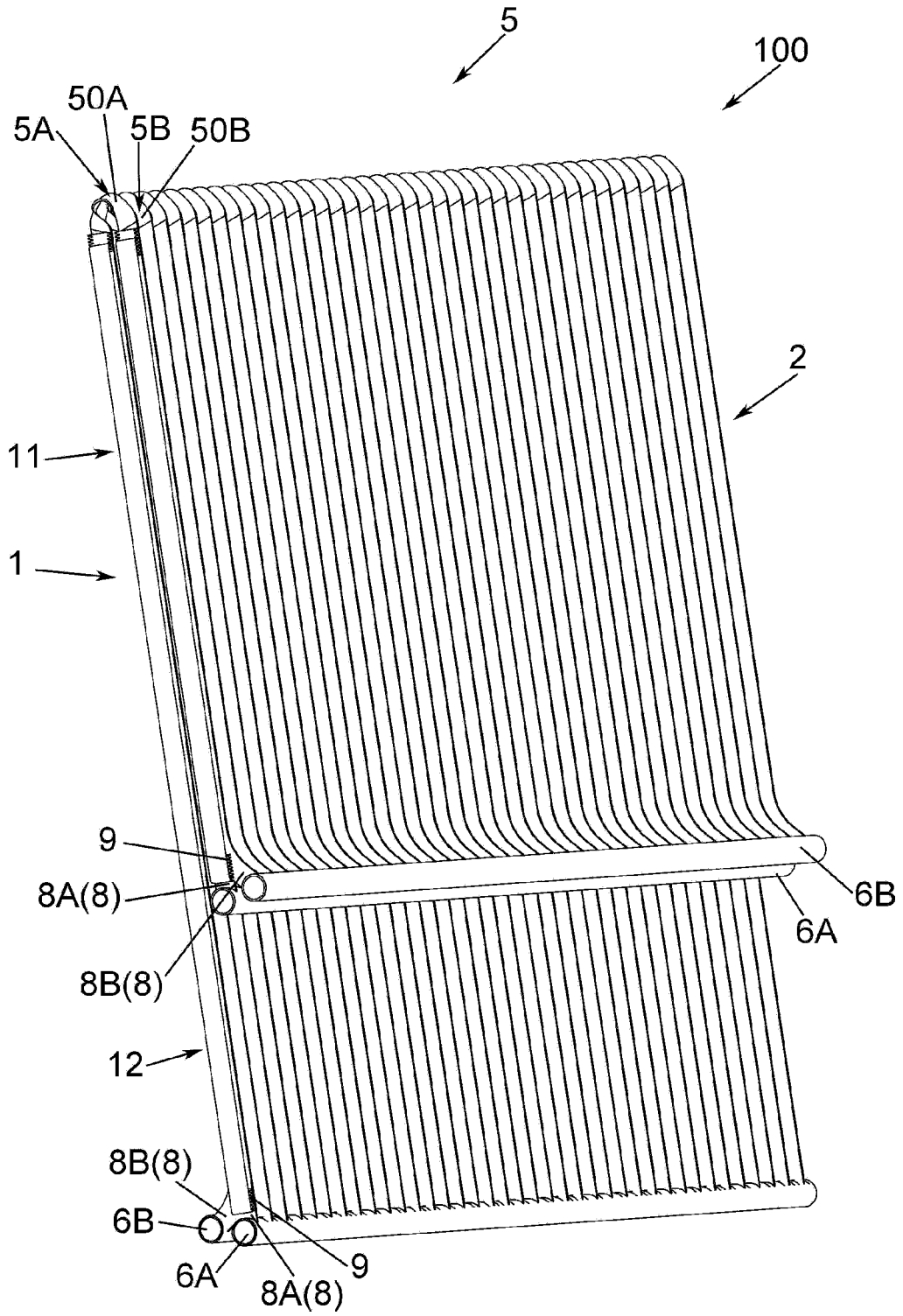
FIG. 2 is a schematic perspective view of the heat exchanger shown in FIG. 1.

The abovementioned heat exchanger 100 for the air conditioning system may act as an evaporator or condenser. In the case of the heat exchanger acting as an evaporator, the refrigerant flows from the second heat exchanger core 2 to the first heat exchanger core 1, and it is more favorable that the wind blows through the heat exchanger 100 along the direction from the first heat exchanger core 1 to the second heat exchanger core 2. Since the heat exchange tubes 8 of the second heat exchanger core 2 have a shorter length, less heat exchange is performed by the second heat exchanger core 2, creating less condensed water to prevent or reduce the occurrence of a situation where the wind blowing out carries water. The wind carrying water will cause the rust of the surrounding parts, or will be blown onto the body of an end user, bringing about a bad use experience. Referring to FIG. 2, the first heat exchanger core 1 further includes a plurality of fins 9 arranged alternately with the heat exchange tubes 8 of the first heat exchanger core 1; and the second heat exchanger core 2 further includes a plurality of fins 9 arranged alternately with the heat exchange tubes 8 of the second heat exchanger core 2.

Referring to FIG. 1 to FIG. 10, in the embodiments of the present disclosure, the heat exchanger 100 further includes: a pair of first circuit manifolds 6A. One of the pair of first circuit manifolds 6A is connected with the plurality of first circuit heat exchange tubes 8A of the first heat exchanger core 1 at a side of the first heat exchanger core 1 away from the connection part 5, and the other of the pair of first circuit manifolds 6A is connected with the plurality of first circuit heat exchange tubes 8A of the second heat exchanger core 2 at a side of the second heat exchanger core 2 away from the connection part 5.

Referring to FIG. 1 to FIG. 10, in the embodiments of the present disclosure, the first connection part 5A includes a plurality of first connection tubes 50A, and the plurality of first circuit heat exchange tubes 8A of the first heat exchanger core 1 are connected with the plurality of first circuit heat exchange tubes 8A of the second heat exchanger core 2 through the plurality of first connection tubes 50A, respectively.

Referring to FIG. 1 to FIG. 10, in the embodiments of the present disclosure, the heat exchange tube 8 of the first heat exchanger core 1 has a length of L1, the heat exchange tube 8 of the second heat exchanger core 2 has a length of L2, and, $\frac{1}{5}<L2/L1<\frac{9}{10}$.

The abovementioned heat exchanger 100 for the air conditioning system may act as an evaporator or condenser. In the case of the heat exchanger 100 acting as an evaporator, after the inventor's extensive experimental research of the heat exchanger 100 acting as the evaporator, it is found that, if the heat exchange tube 8 of the first heat exchanger core 1 has a length of L1 and the heat exchange tube 8 of the second heat exchanger core 2 has a length of L2, when it is satisfied that $\frac{1}{5}<L2/L1<\frac{9}{10}$, the heat exchange strengths of the first heat exchanger core 1 and the second heat exchanger core 2 can be adjusted within a reasonable range, and the distribution of the condensed water amount of the heat exchanger on the different heat exchanger cores can be adjusted. It should be noted that in an actual air conditioning system, the condensed water amount of the heat exchanger core near an inner side of a room should be reduced. In other words, the condensed water amount of the second heat exchanger core 2 of the abovementioned heat exchanger should be reduced.

Referring to FIG. 1 to FIG. 3 and FIG. 6 to FIG. 10, in the embodiments of the present disclosure, the plurality of heat exchange tubes 8 of each of the first heat exchanger core 1 and the second heat exchanger core 2 include a plurality of second circuit heat exchange tubes 8B for forming a second circuit.

Referring to FIG. 1 to FIG. 3 and FIG. 6 to FIG. 10, in examples of the present disclosure, the heat exchanger 100 further includes: a pair of second circuit manifolds 6B. One of the pair of second circuit manifolds 6B is connected with the plurality of second circuit heat exchange tubes 8B of the first heat exchanger core 1 at a side of the first heat exchanger core 1 away from the connection part 5, and the other of the pair of second circuit manifolds 6B is connected with the plurality of second circuit heat exchange tubes 8B of the second heat exchanger core 2 at a side of the second heat exchanger core 2 away from the connection part 5.

Referring to FIG. 2, in examples of the present disclosure, the connection part 5 further includes a second connection part 5B, and the plurality of second circuit heat exchange tubes 8B of the first heat exchanger core 1 are connected with the plurality of second circuit heat exchange tubes 8B of the second heat exchanger core 2 through the second connection part 5B. The second connection part 5B may include a plurality of second connection tubes 50B, and the plurality of second circuit heat exchange tubes 8B of the first heat exchanger core 1 are connected with the plurality of second circuit heat exchange tubes 8B of the second heat exchanger core 2 through the plurality of second connection tubes 50B, respectively.

Figure 6:
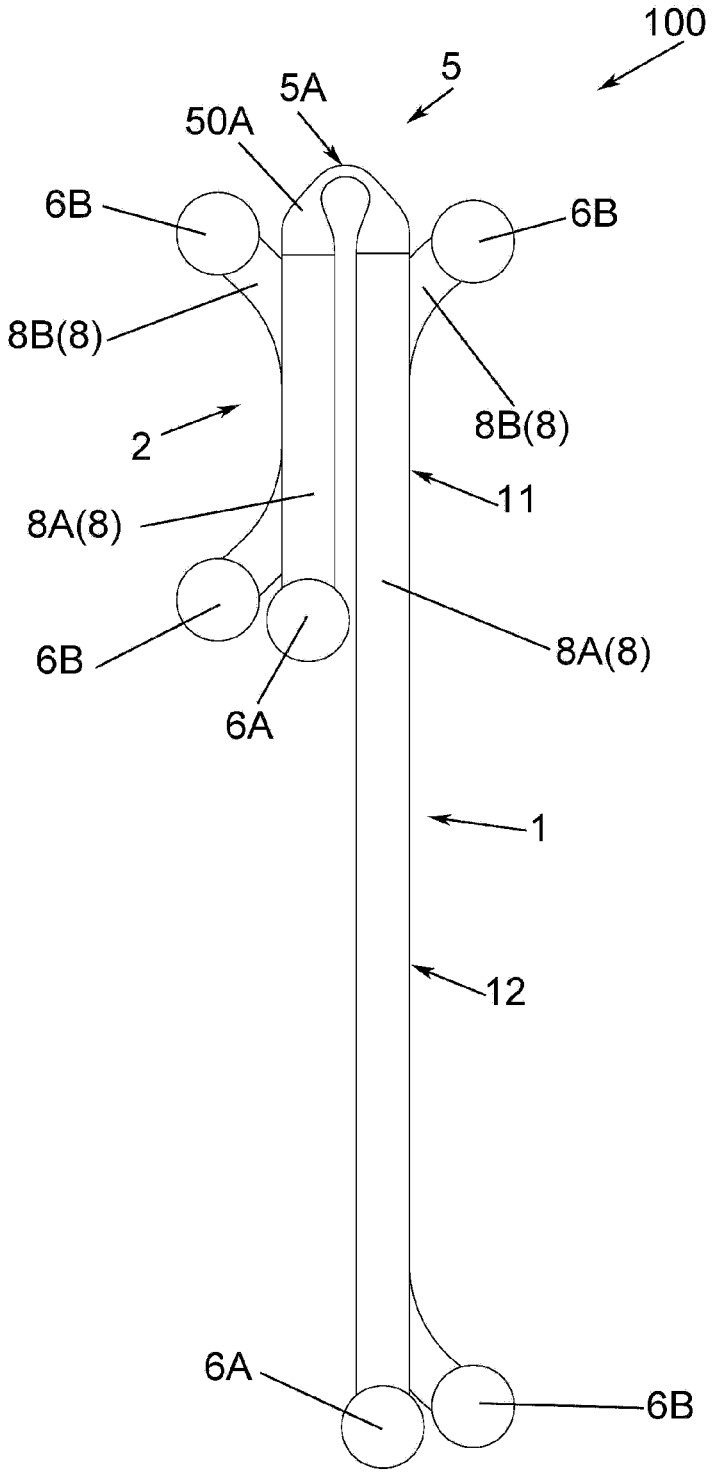
FIG. 6 is a schematic side view of a heat exchanger according to still another embodiment of the present disclosure.
Figure 7:
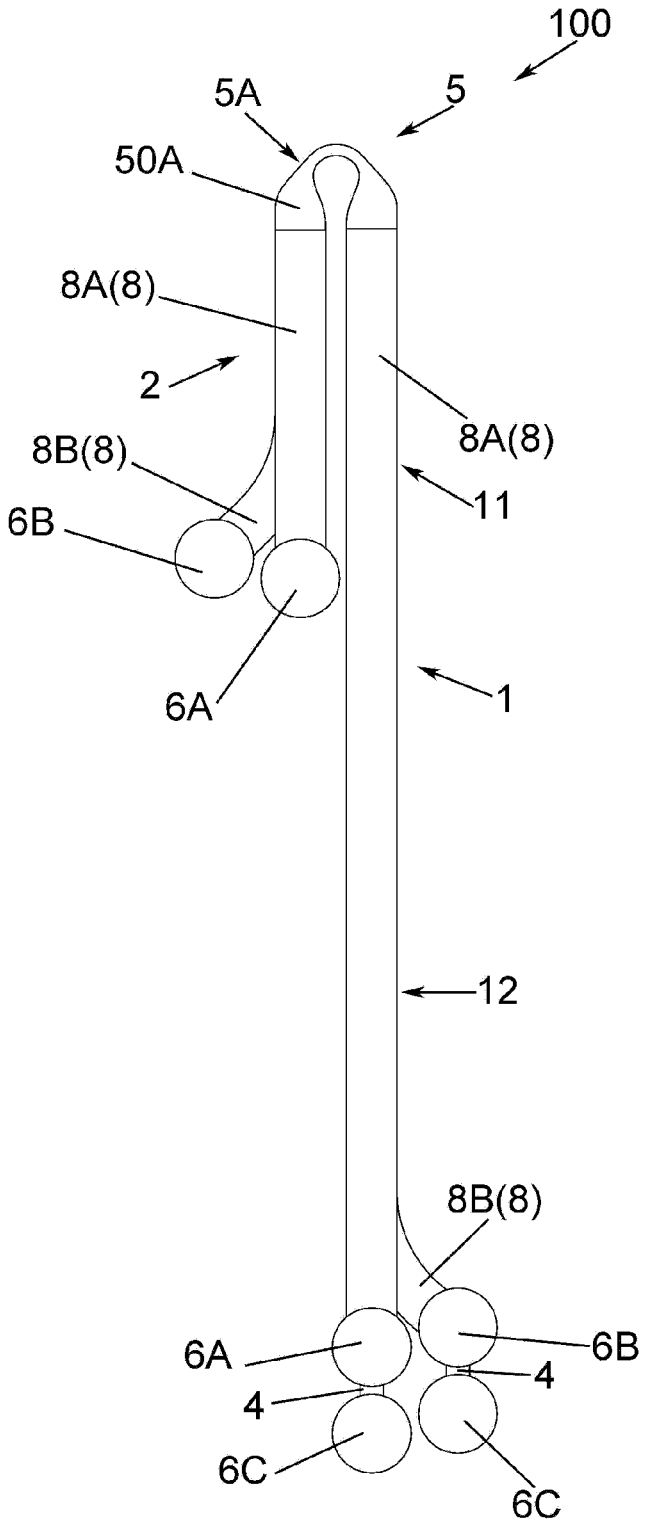
FIG. 7 is a schematic side view of another modification of the heat exchanger shown in FIG. 1.
Figure 8:
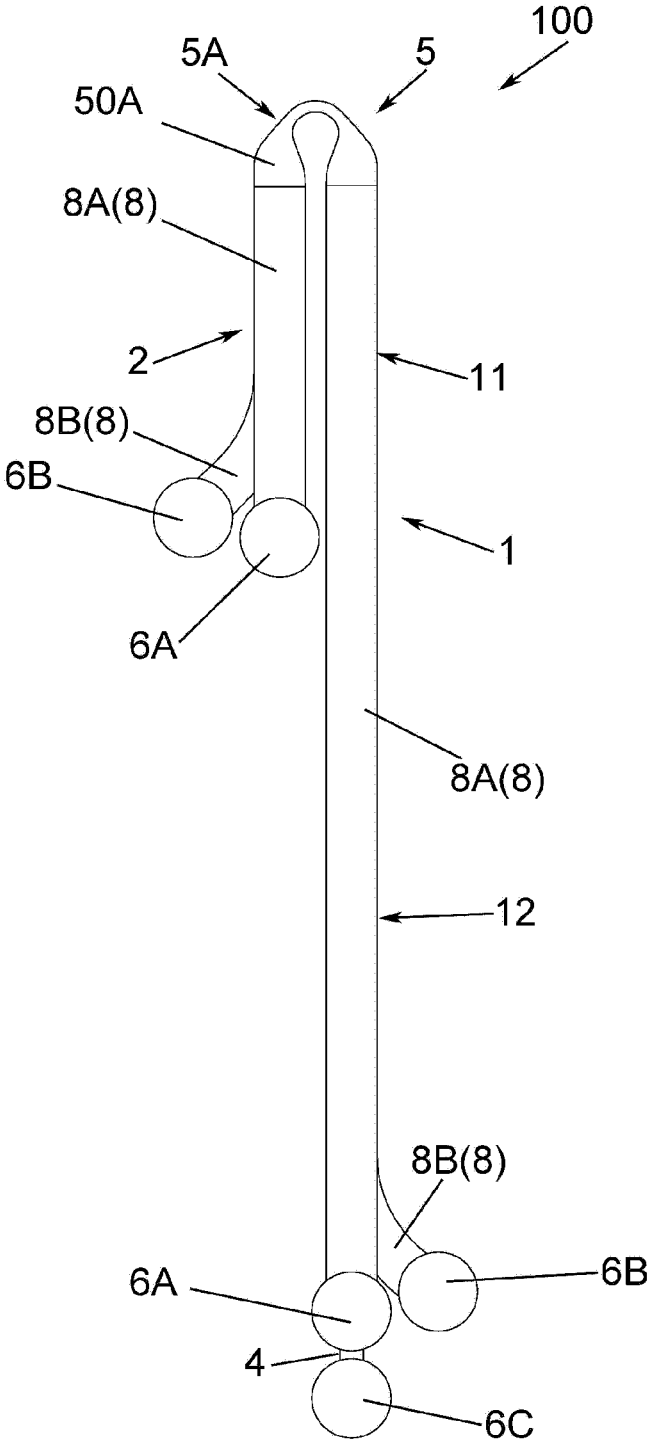
FIG. 8 is a schematic side view of yet another modification of the heat exchanger shown in FIG. 1.
Figure 9:
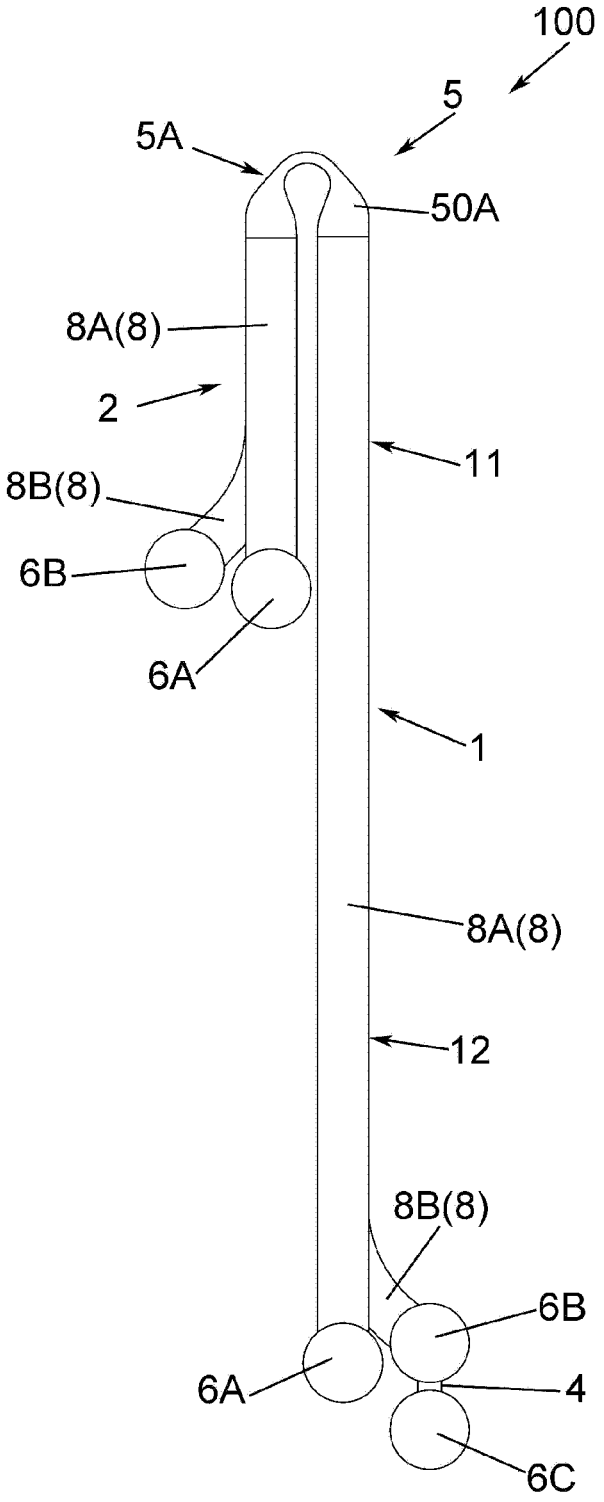
FIG. 9 is a schematic side view of still another modification of the heat exchanger shown in FIG. 1.

Referring to FIG. 6, in examples of the present disclosure, the heat exchanger 100 further includes: another pair of second circuit manifolds 6B. One of the other pair of second circuit manifolds 6B is connected with the plurality of second circuit heat exchange tubes 8B of the first heat exchanger core 1 at a side of the first heat exchanger core 1 near the connection part 5, and the other of the other pair of second circuit manifolds 6B is connected with the plurality of second circuit heat exchange tubes 8B of the second heat exchanger core 2 at a side of the second heat exchanger core 2 near the connection part 5. In this case, the second circuit of the first heat exchanger core 1 and the second circuit of the second heat exchanger core 2 form one second circuit when the other pair of second circuit manifolds 6B are fluidly connected to each other, while the second circuit of the first heat exchanger core 1 and the second circuit of the second heat exchanger core 2 form two separate second circuits when the other pair of second circuit manifolds 6B are fluidly separated from each other.

Figure 4:
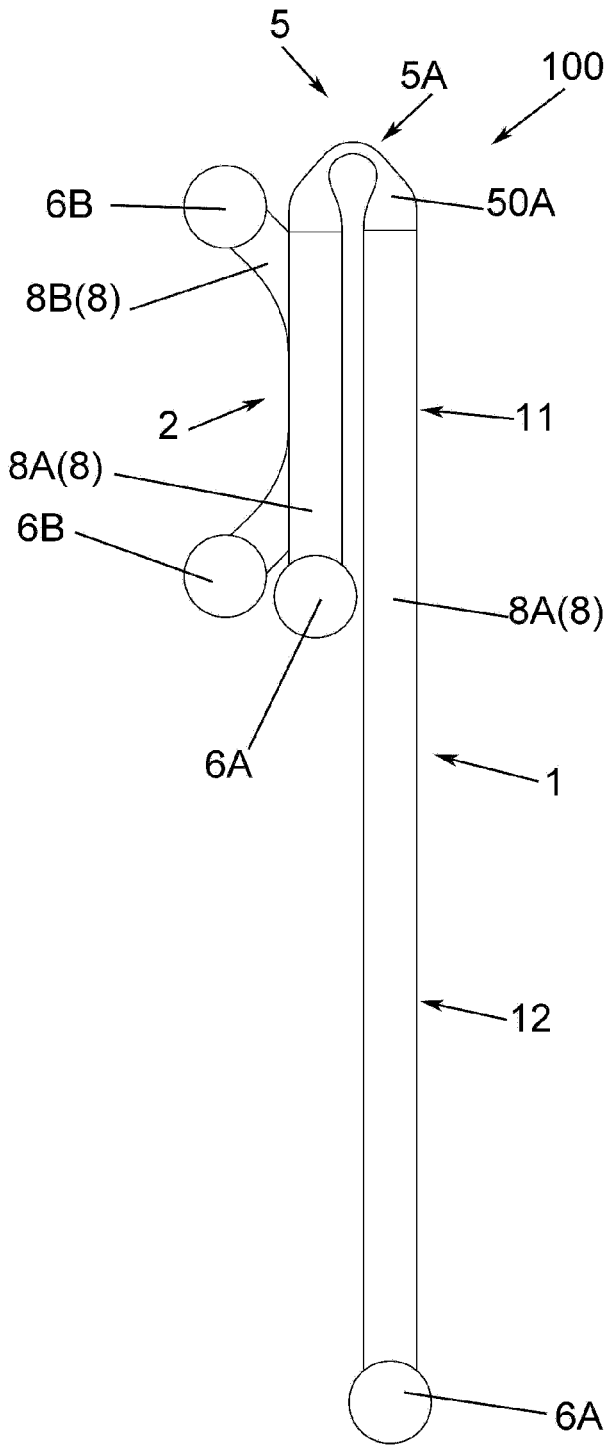
FIG. 4 is a schematic side view of a heat exchanger according to another embodiment of the present disclosure.

Referring to FIG. 4, in examples of the present disclosure, the plurality of heat exchange tubes 8 of only the second heat exchanger core 2 further include the plurality of second circuit heat exchange tubes 8B for forming the second circuit. The heat exchanger 100 may further include a pair of second circuit manifolds 6B. One of the pair of second circuit manifolds 6B is connected with the plurality of second circuit heat exchange tubes 8B of the second heat exchanger core 2 at a side of the second heat exchanger core 2 near the connection part 5, and the other of the pair of second circuit manifolds 6B is connected with the plurality of second circuit heat exchange tubes 8B of the second heat exchanger core 2 at a side of the second heat exchanger core 2 away from the connection part 5.

Figure 5:
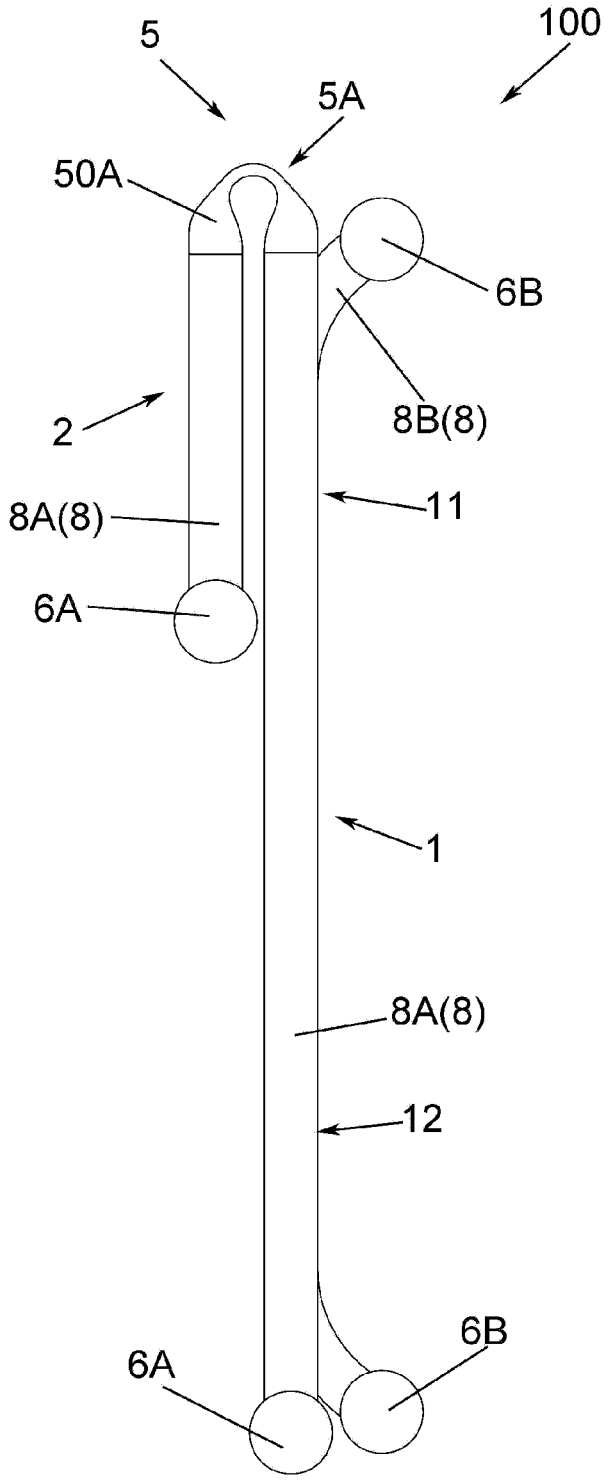
FIG. 5 is a schematic side view of a heat exchanger according to yet another embodiment of the present disclosure.

Referring to FIG. 5, in examples of the present disclosure, the plurality of heat exchange tubes 8 of only the first heat exchanger core 1 further include the plurality of second circuit heat exchange tubes 8B for forming the second circuit. The heat exchanger 100 may further include a pair of second circuit manifolds 6B. One of the pair of second circuit manifolds 6B is connected with the plurality of second circuit heat exchange tubes 8B of the first heat exchanger core 1 at a side of the first heat exchanger core 1 away from the connection part 5, and the other of the pair of second circuit manifolds 6B is connected with the plurality of second circuit heat exchange tubes 8B of the first heat exchanger core 1 at a side of the first heat exchanger core 1 near the connection part 5.

It should be noted that in the above examples of the present disclosure shown in FIG. 4 to FIG. 6, the heat exchange strength requirements of the different circuits are met by varying the lengths of the heat exchange tubes of the different circuits. When the heat exchanger according to the examples of the present disclosure acts as the evaporator, the condensed water amounts of the heat exchanger core 1 and the heat exchanger core 2 can be effectively adjusted to reduce the problems that water is blown out from the evaporator in the air conditioning system. Moreover, with this design, the heat exchange strengths of one or more of the circuits can be changed in a large range while making full use of the fin efficiency. For example, when a certain circuit with a small heat exchange strength is needed, reference may be made to the designs in the examples shown in FIG. 4 and FIG. 5, in which the circuit corresponding to the heat exchange tubes 8B can obtain a small heat exchange strength.

Referring to FIG. 1 to FIG. 3 and FIG. 7 to FIG. 9, in examples of the present disclosure, one of the pair of first circuit manifolds 6A is located at a refrigerant outlet side of the heat exchanger 100, and one of the pair of second circuit manifolds 6B is located at the refrigerant outlet side of the heat exchanger 100. The heat exchanger 100 may further include: an outlet side manifold 6C which is in fluid communication with at least one of the first circuit manifold 6A at the refrigerant outlet side of the heat exchanger 100 and the second circuit manifold 6B at the refrigerant outlet side of the heat exchanger 100 through a connection tube 4. The side of the first heat exchanger core 1 away from the connection part 5 may be the refrigerant outlet side of the heat exchanger 100.

Figure 3:
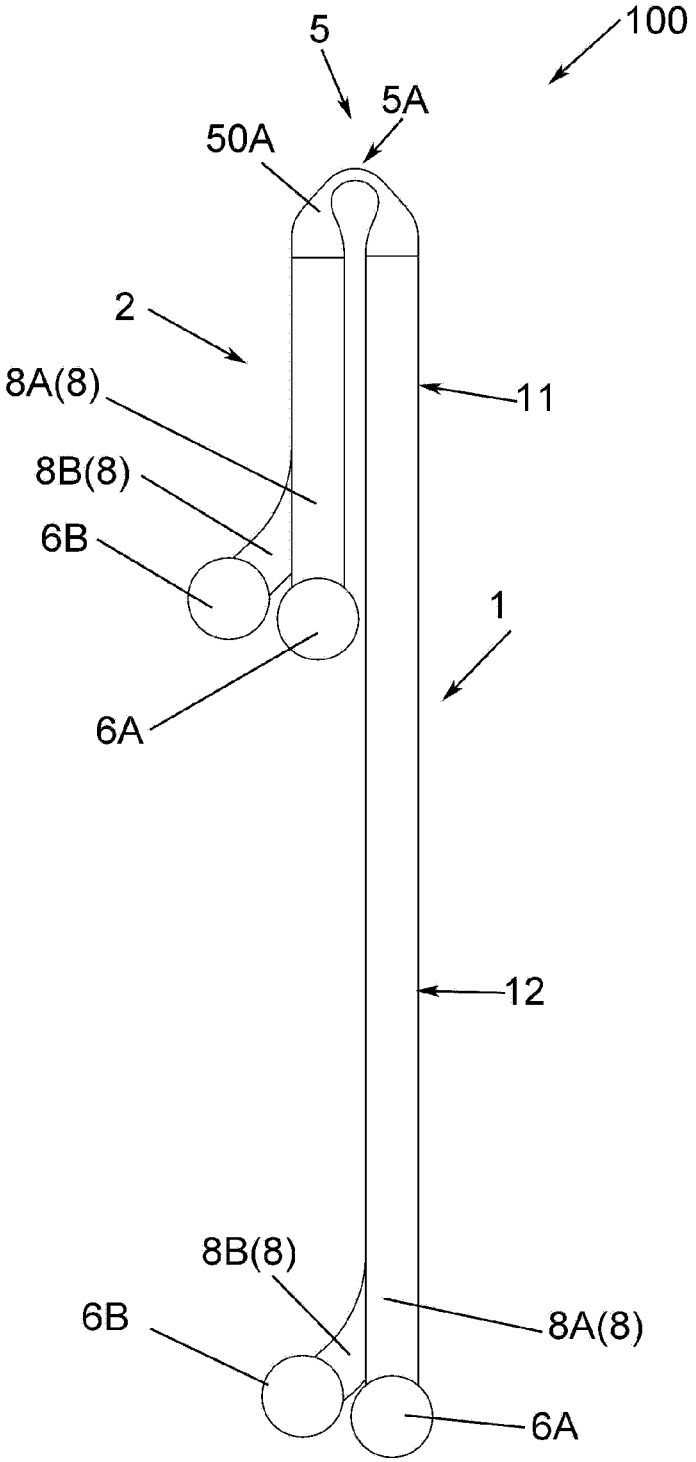
FIG. 3 is a schematic side view of a modification of the heat exchanger shown in FIG. 1.

Referring to FIG. 1 to FIG. 3, in examples of the present disclosure, the one (the lower one shown in the figures) of the pair of first circuit manifolds 6A is provided at a side of the one (the lower one shown in the figures) of the pair of second circuit manifolds 6B away from or towards the second heat exchanger core 2.

Figure 10:
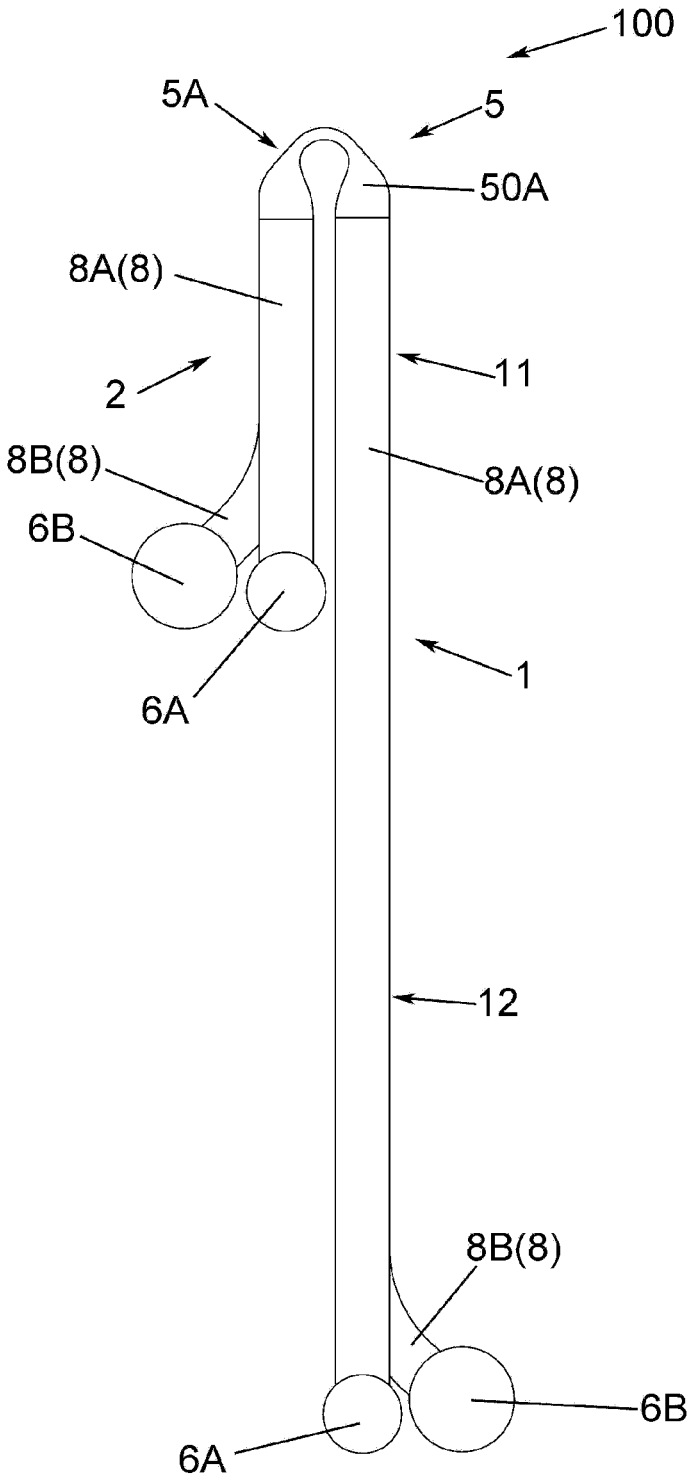
FIG. 10 is a schematic side view of a further modification of the heat exchanger shown in FIG. 1.

Referring to FIG. 10, in examples of the present disclosure, a cross-sectional area of the first circuit manifold 6A is different from that of the second circuit manifold 6B, or an outer diameter of the first circuit manifold 6A is different from that of the second circuit manifold 6B. For example, the cross-sectional area of the first circuit manifold 6A may be greater than or less than that of the second circuit manifold 6B, or the outer diameter of the first circuit manifold 6A may be greater than or less than that of the second circuit manifold 6B. In addition, a cross-sectional area of a flow channel of the first circuit heat exchange tube 8A is different from that of a flow channel of the second circuit heat exchange tube 8B; or the first circuit heat exchange tube 8A is a flat tube, the second circuit heat exchange tube 8B is a flat tube, a width of the first circuit heat exchange tube 8A is different from that of the second circuit heat exchange tube 8B (here, the width direction of the heat exchange tube is the left-right direction in FIG. 1 and FIG. 3 to FIG. 10); or the first circuit heat exchange tube 8A is a flat tube, the second circuit heat exchange tube 8B is a flat tube, a thickness of the first circuit heat exchange tube 8A is different from that of the second circuit heat exchange tube 8B (here, the thickness direction of the heat exchange tube is a direction along which the first circuit heat exchange tube groups and the second circuit heat exchange tube groups are arranged alternately). For example, the cross-sectional area of the flow channel of the first circuit heat exchange tube 8A may be greater than or less than that of the flow channel of the second circuit heat exchange tube 8B; or the width of the first circuit heat exchange tube 8A may be greater than or less than that of the second circuit heat exchange tube 8B; or the thickness of the first circuit heat exchange tube 8A may be greater than or less than that of the second circuit heat exchange tube 8B.

Figure 11:
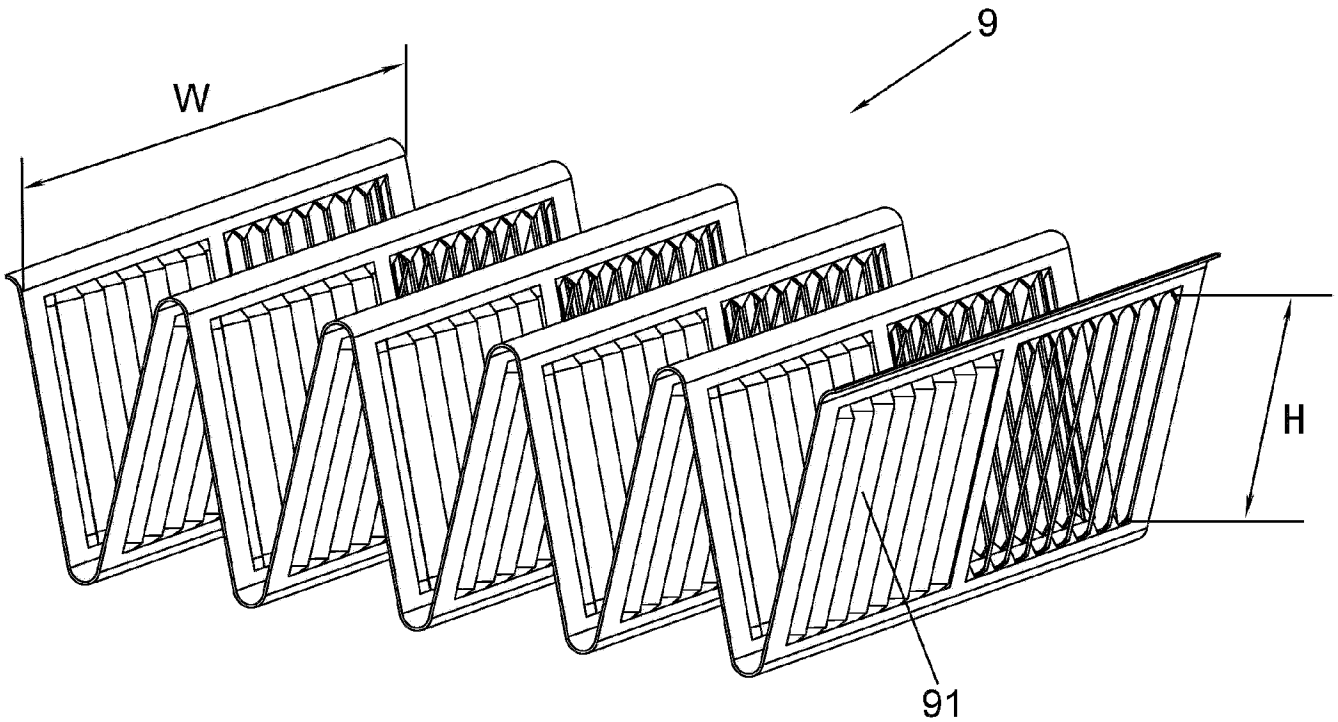
FIG. 11 is a schematic perspective view of a fin of a heat exchanger according to an embodiment of the present disclosure.
Figure 12:
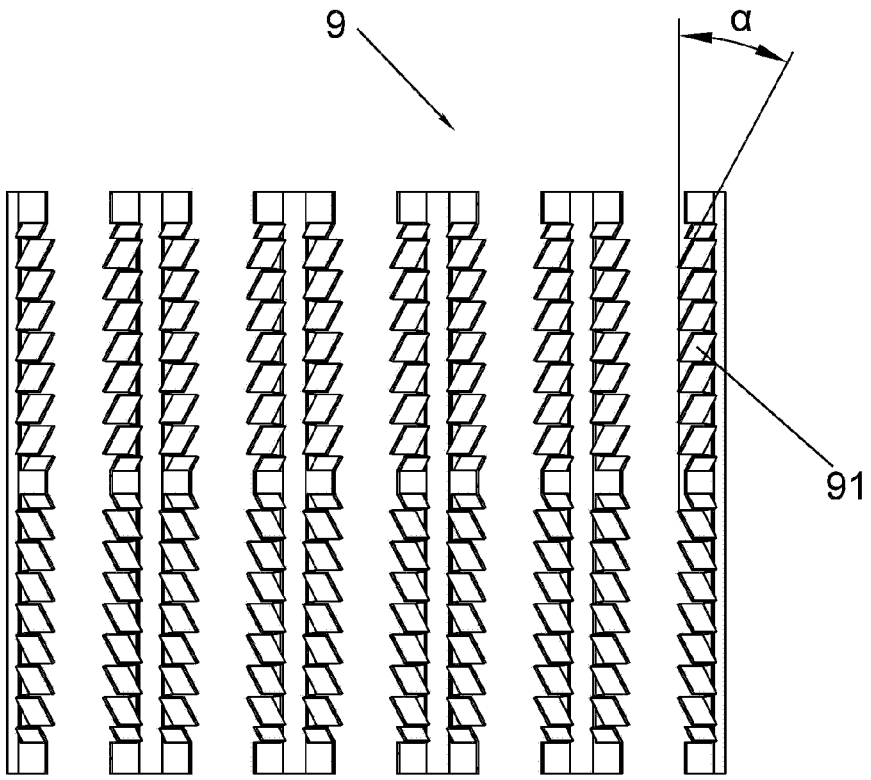
FIG. 12 is a schematic sectional view of the fin shown in FIG. 11.

Referring to FIG. 2, in examples of the present disclosure, the first heat exchanger core 1 further includes a plurality of fins 9 arranged alternately with the plurality of heat exchange tubes 8 of the first heat exchanger core 1; the second heat exchanger core 2 further includes a plurality of fins 9 arranged alternately with the plurality of heat exchange tubes 8 of the second heat exchanger core 2. The first heat exchanger core 1 includes a first portion 11 and a second portion 12. An orthographic projection of the first portion 11 on a plane where the first heat exchanger core 1 is located is at least partially overlapped with an orthographic projection of the second heat exchanger core 2 on the plane where the first heat exchanger core 1 is located, and an orthographic projection of the second portion 12 on the plane where the first heat exchanger core 1 is located is located outside the orthographic projection of the second heat exchanger core 2 on the plane where the first heat exchanger core 1 is located. At a same inlet wind speed at which the wind blows into the heat exchanger, a wind resistance or pressure drop caused by at least a portion of at least one of the fins 9 in the second portion 12 is greater than a wind resistance or pressure drop caused by at least a portion of at least one of the fins 9 in at least one of the second heat exchanger core 2 and the first portion 11. For example, referring to FIG. 11 and FIG. 12, in the aspect of at least one of a fin density, a fin width W, an angle $\alpha$ of a fin louver 91 (which is an angle between the fin louver 91 and the width direction of the fin 9), a quantity of the fin louvers 91 and a length H of the fin louver 91, at least a portion of at least one of the fins 9 in the second portion 12 is greater than at least a portion of at least one of the fins 9 in at least one of the second heat exchanger core 2 and the first portion 11. Thus, the wind field on the surface of the heat exchanger can be made more uniform, and the heat exchange performance can be improved. The heat exchanger may be divided into one part constituted by the first portion 11 and the second heat exchanger core 2, and the other part constituted by the second portion 12. At used herein, "at a same inlet wind speed" does not mean that the inlet wind speeds of one part and the other part must be the same when the heat exchanger operates, but means that the measurements need to be performed for comparison at the same inlet wind speed. For the wavy fins shown in FIG. 11 and FIG. 12, the fin density may be the number of peaks or valleys per unit length of the wave. If the fin is a plate-like fin through which the heat exchange tubes pass, the fin density means the number of fins per unit length along a direction perpendicular to the plane in which the fin extends.

Although the manifold is described in conjunction with the accompanying drawings, the manifold may have any suitable shape and structure, and is not limited to those shown in the figures.

With the heat exchanger 100 according to the embodiments of the present disclosure, the performance of the heat exchanger 100 can be improved.

Although the above embodiments are described, some features of the above embodiments may be combined to form new embodiments.

What is claimed is:

1. An air conditioning system, comprising:

a heat exchanger, comprising:

a first heat exchanger core comprising a plurality of heat exchange tubes, the plurality of heat exchange tubes of the first heat exchanger core comprising a plurality of first circuit heat exchange tubes for forming a first part of a first circuit;

a second heat exchanger core located on a side of the first heat exchanger core in a thickness direction of the first heat exchanger core and comprising a plurality of heat exchange tubes, the plurality of heat exchange tubes of the second heat exchanger core comprising a plurality of first circuit heat exchange tubes for forming a second part of the first circuit, a length of the heat exchange tube of the first heat exchanger core being greater than a length of the heat exchange tube of the second heat exchanger core; and a connection part comprising a first connection part through which the plurality of first circuit heat exchange tubes of the first heat exchanger core are connected with the plurality of first circuit heat exchange tubes of the second heat exchanger core;

wherein the plurality of heat exchange tubes of at least one of the first heat exchanger core and the second heat exchanger core further comprise a plurality of second circuit heat exchange tubes for forming a first part of a second circuit, and in the at least one of the first heat exchanger core and the second heat exchanger core, first circuit heat exchange tube groups each constituted by at least one of the plurality of first circuit heat exchange tubes and second circuit heat exchange tube groups each constituted by at least one of the plurality of second circuit heat exchange tubes are arranged alternately;

wherein the heat exchange tube of the first heat exchanger core has a length of L1, the heat exchange tube of the second heat exchanger core has a length of L2, and $\frac{1}{5}<L2/L1<\frac{9}{10}$; and wherein the first heat exchanger core and the second heat exchanger core are arranged such that wind blows through the heat exchanger along a direction from the first heat exchanger core to the second heat exchanger core.

2. The air conditioning system according to claim 1, wherein:

the first heat exchanger core further comprises a plurality of fins arranged alternately with the plurality of heat exchange tubes of the first heat exchanger core; and the second heat exchanger core further comprises a plurality of fins arranged alternately with the plurality of heat exchange tubes of the second heat exchanger core.

3. The air conditioning system according to claim 1, wherein:

the first connection part comprises a plurality of first connection tubes, and the plurality of first circuit heat exchange tubes of the first heat exchanger core are connected with the plurality of first circuit heat exchange tubes of the second heat exchanger core through the plurality of first connection tubes, respectively.

4. The air conditioning system according to claim 1, wherein:

a cross-sectional area of a flow channel of the first circuit heat exchange tube is different from that of a flow channel of the second circuit heat exchange tube; or the first circuit heat exchange tube is a flat tube, the second circuit heat exchange tube is a flat tube, and a width of the first circuit heat exchange tube is different from that of the second circuit heat exchange tube; or the first circuit heat exchange tube is a flat tube, the second circuit heat exchange tube is a flat tube, and a thickness of the first circuit heat exchange tube is different from that of the second circuit heat exchange tube.

5. The air conditioning system according to claim 1, wherein the first heat exchanger core and the second heat exchanger core are configured to flow a refrigerant from the second heat exchanger core to the first heat exchanger core.

6. The air conditioning system according to claim 1, wherein:

the plurality of heat exchange tubes of only the second heat exchanger core comprise the plurality of second circuit heat exchange tubes for forming the first part of the second circuit.

7. The air conditioning system according to claim 6, further comprising:

a pair of second circuit manifolds, of which one is connected with the plurality of second circuit heat exchange tubes of the second heat exchanger core at a side of the second heat exchanger core near the connection part, and of which the other is connected with the plurality of second circuit heat exchange tubes of the second heat exchanger core at a side of the second heat exchanger core away from the connection part.

8. The air conditioning system according to claim 1, wherein:

the plurality of heat exchange tubes of only the first heat exchanger core comprise the plurality of second circuit heat exchange tubes for forming the first part of the second circuit.

9. The air conditioning system according to claim 8, further comprising:

a pair of second circuit manifolds, of which one is connected with the plurality of second circuit heat exchange tubes of the first heat exchanger core at a side of the first heat exchanger core away from the connection part, and of which the other is connected with the plurality of second circuit heat exchange tubes of the first heat exchanger core at a side of the first heat exchanger core near the connection part.

10. The air conditioning system according to claim 1, further comprising:

a pair of first circuit manifolds, of which one is connected with the plurality of first circuit heat exchange tubes of the first heat exchanger core at a side of the first heat exchanger core away from the connection part, and of which the other is connected with the plurality of first circuit heat exchange tubes of the second heat exchanger core at a side of the second heat exchanger core away from the connection part.

11. The air conditioning system according to claim 10, wherein:

the first heat exchanger core further comprises a plurality of fins arranged alternately with the plurality of heat exchange tubes of the first heat exchanger core;

the second heat exchanger core further comprises a plurality of fins arranged alternately with the plurality of heat exchange tubes of the second heat exchanger core;

the first heat exchanger core comprises a first portion and a second portion, an orthographic projection of the first portion on a plane where the first heat exchanger core is located is at least partially overlapped with an orthographic projection of the second heat exchanger core on the plane where the first heat exchanger core is located, and an orthographic projection of the second portion on the plane where the first heat exchanger core is located is located outside the orthographic projection of the second heat exchanger core on the plane where the first heat exchanger core is located; and at a same inlet wind speed, a wind resistance or pressure drop caused by at least a portion of at least one of the fins in the second portion is greater than a wind resistance or pressure drop caused by at least a portion of at least one of the fins in at least one of the second heat exchanger core and the first portion.

12. The air conditioning system according to claim 1, wherein:

the plurality of heat exchange tubes of the first heat exchanger core comprise the plurality of second circuit heat exchange tubes for forming the first part of the second circuit;

the plurality of heat exchange tubes of the second heat exchanger core comprise a plurality of second circuit heat exchange tubes for forming a second part of the second circuit.

13. The air conditioning system according to claim 12, further comprising:

a pair of second circuit manifolds, of which one is connected with the plurality of second circuit heat exchange tubes of the first heat exchanger core at a side of the first heat exchanger core away from the connection part, and of which the other is connected with the plurality of second circuit heat exchange tubes of the second heat exchanger core at a side of the second heat exchanger core away from the connection part.

14. The air conditioning system according to claim 13, wherein:

the connection part further comprises a second connection part, and the plurality of second circuit heat exchange tubes of the first heat exchanger core are connected with the plurality of second circuit heat exchange tubes of the second heat exchanger core through the second connection part.

15. The air conditioning system according to claim 13, further comprising:

another pair of second circuit manifolds, of which one is connected with the plurality of second circuit heat exchange tubes of the first heat exchanger core at a side of the first heat exchanger core near the connection part, and of which the other is connected with the plurality of second circuit heat exchange tubes of the second heat exchanger core at a side of the second heat exchanger core near the connection part.

16. The air conditioning system according to claim 13, further comprising:

a pair of first circuit manifolds, of which one is connected with the plurality of first circuit heat exchange tubes of the first heat exchanger core at the side of the first heat exchanger core away from the connection part, and of which the other is connected with the plurality of first circuit heat exchange tubes of the second heat exchanger core at the side of the second heat exchanger core away from the connection part, wherein one of the pair of first circuit manifolds is located at a refrigerant outlet side of the heat exchanger, and one of the pair of second circuit manifolds is located at the refrigerant outlet side of the heat exchanger; and an outlet side manifold, which is in fluid communication with at least one of the first circuit manifold at the refrigerant outlet side of the heat exchanger and the second circuit manifold at the refrigerant outlet side of the heat exchanger through a connection tube.

17. The air conditioning system according to claim 13, further comprising:

a pair of first circuit manifolds, of which one is connected with the plurality of first circuit heat exchange tubes of the first heat exchanger core at the side of the first heat exchanger core away from the connection part, and of which the other is connected with the plurality of first circuit heat exchange tubes of the second heat exchanger core at the side of the second heat exchanger core away from the connection part, wherein the one of the pair of first circuit manifolds is provided at a side of the one of the pair of second circuit manifolds away from the second heat exchanger core, or the one of the pair of first circuit manifolds is provided at a side of the one of the pair of second circuit manifolds towards the second heat exchanger core.

18. The air conditioning system according to claim 13, further comprising:

a pair of first circuit manifolds, of which one is connected with the plurality of first circuit heat exchange tubes of the first heat exchanger core at the side of the first heat exchanger core away from the connection part, and of which the other is connected with the plurality of first circuit heat exchange tubes of the second heat exchanger core at the side of the second heat exchanger core away from the connection part;

wherein a cross-sectional area of one of the pair of first circuit manifolds is different from that of one of the pair of second circuit manifolds, or an outer diameter of the one of the pair of first circuit manifolds is different from that of the one of the pair of second circuit manifolds.

* * * * *